US010328957B2

(12) United States Patent
Wilt et al.

(10) Patent No.: US 10,328,957 B2
(45) **Date of Patent: *Jun. 25, 2019**

(54) RAILCAR DRAFT GEAR ASSEMBLY

(71) Applicant: MINER ENTERPRISES, INC., Geneva, IL (US)

(72) Inventors: Donald E. Wilt, Batavia, IL (US); Robert J. Pokorski, Atlantic Mine, MI (US); Keith A. Salis, Clare, IL (US); Erich A. Schoedl, Sugar Grove, IL (US)

(73) Assignee: Miner Enterprises, Inc., Geneva, IL (US)

( * ) Notice: Subject to any disclaimer, the term of this patent is extended or adjusted under 35 U.S.C. 154(b) by 113 days.

This patent is subject to a terminal disclaimer.

(21) Appl. No.: 15/483,094

(22) Filed: Apr. 10, 2017

(65) Prior Publication Data

US 2017/0210398 A1 Jul. 27, 2017

Related U.S. Application Data

(63) Continuation of application No. 14/468,033, filed on Aug. 25, 2014, now Pat. No. 9,789,888.

(51) Int. Cl.

| | |
|---|---|
| ***B61G 9/06*** | (2006.01) |
| ***B61G 9/14*** | (2006.01) |
| ***B61G 9/10*** | (2006.01) |

(52) U.S. Cl.

CPC ..... *B61G 9/06* (2013.01); *B61G 9/10* (2013.01); *B61G 9/14* (2013.01)

(58) Field of Classification Search

CPC ..... B61G 9/06; B61G 9/10; B61G 9/14

USPC ..... 213/22, 40 R, 45

See application file for complete search history.

(56) References Cited

U.S. PATENT DOCUMENTS

| | | | | | |
|---|---|---|---|---|---|
| 2,897,981 | A * | 8/1959 | Blattner | B61G 9/06 | 213/45 |
| 3,202,300 | A * | 8/1965 | Holm | B61G 9/06 | 213/22 |
| 3,491,898 | A * | 1/1970 | Suckow | B61G 9/06 | 213/22 |
| 3,712,479 | A * | 1/1973 | Atkinson | B61G 9/06 | 213/45 |
| 3,838,778 | A * | 10/1974 | Appleton | B61G 9/06 | 213/40 R |
| 2007/0175851 | A1* | 8/2007 | Hogbring | B60D 1/50 | 213/62 R |
| 2011/0253663 | A1* | 10/2011 | Liu | B61G 9/06 | 213/75 R |
| 2012/0118847 | A1* | 5/2012 | Carlstedt | B61G 9/06 | 213/45 |
| 2012/0292279 | A1* | 11/2012 | Wilt | B61G 9/06 | 213/22 |
| 2013/0153526 | A1* | 6/2013 | Wilt | B61G 9/12 | 213/32 C |

(Continued)

*Primary Examiner* — Zachary L Kuhfuss

(74) *Attorney, Agent, or Firm* — Law Office of John W. Harbst

(57) ABSTRACT

A railcar draft gear assembly specifically designed to consistently and repeatedly withstand up to about 110,000 ft-lbs of energy imparted thereto while not exceeding a force level of 900,000 lbs. and while having a wedge member of the draft gear assembly travel in an inward axial direction of less than about 4.5 inches relative to an open end of the draft gear.

3 Claims, 9 Drawing Sheets

(56) References Cited

U.S. PATENT DOCUMENTS

| | | | | |
|---|---|---|---|---|
| 2013/0168346 | A1* | 7/2013 | Wilt | B61G 9/06 213/22 |
| 2014/0202973 | A1* | 7/2014 | Wilt | B61G 9/06 213/45 |
| 2015/0014267 | A1* | 1/2015 | Creighton | B61G 9/10 213/65 |

* cited by examiner

RAILCAR DRAFT GEAR ASSEMBLY

RELATED APPLICATION

This patent application is a continuation patent application of co-assigned U.S. patent application Ser. No. 14/468,033, filed Aug. 25, 2014, now U.S. Pat. No. 9,789,888; the entirety of which is incorporated herein by reference.

FIELD OF THE INVENTION DISCLOSURE

This invention disclosure generally relates to railcar draft gears and, more specifically, to a railcar draft gear assembly specifically designed to consistently and repeatedly withstand up to about 110,000 ft-lbs of energy imparted thereto while not exceeding a force level of 900,000 lbs. while having a wedge member of the draft gear assembly travel in an inward axial direction approximating 4.5 inches relative to an open end of the draft gear.

BACKGROUND

As railroads push to increase car capacity to handle the increasing demands on the transportation network, freight car designers/builders have been stepping up to the challenge. With the overall train lengths limited by system constraints such as passing siding lengths, the challenge has been how to achieve more railcar capacity in the same or shorter lengths of freight cars and trains. Freight car designers/builders have heretofore met this challenge by pushing the top and bottom of the defined clearance line envelopes to the limits allowed by the Association of American Railroads (the "AAR"). Additionally, car designers/builders have utilized modern design tools to make freight car designs lighter in weight, while still meeting the AAR standard design loads whereby allowing each freight car to carry more lading while maintaining maximum allowable gross rail loads.

During the process of assembling or "making-up" a freight train, railcars are run into and collide with each other to couple them together. Since time is money, the speed at which the railcars are coupled has significantly increased. Moreover, and because of their increased capacity, the railcars are heavier than before. These two factors and others have resulted in increased damages to the railcars when they collide and, frequently, to the lading carried within such railcars.

Providing an energy absorption/coupling system at opposed ends of each railcar has long been known. Such a system typically includes a coupler for releasably attaching two railcars to each other and a draft gear assembly arranged in operable combination with each coupler for absorbing, dissipating and returning energy imparted thereto during make-up of the train consist and during operation of the railcar. As railroad car designer/builders have reduced the weight of their designs, however, they have also identified a need to protect the integrity of the railcar due to excessive longitudinal loads being placed thereon, especially as the railcars are coupled to each other. Such longitudinal loads frequently exceed the design loads set by the AAR.

While conventional draft gears have high shock absorbing capacities and capabilities, they tend to transmit high magnitude of force to the railcar structure during a work cycle. Of course, transmitting a high magnitude of force to the railcar structure can result in damages to the goods being carried by the railcar and the railcar itself.

A conventional draft gear assembly is disposed within a pocket defined by a centersill on the railcar and has an operative length of travel in one direction of movement of about 3.5 inches before solid stops limit the travel and no more energy can be absorbed by the draft gear. Over this limited distance, the energy of the moving railcar must be absorbed so as to reduce the impact forces and resulting damage to the adjacent railcar to be coupled thereto. Largely because of their increased coupling speeds and the increased weights of the loads being carried thereby, heretofore known energy absorption/coupling systems have been shown to be inadequate. As such, railcars are experiencing severe end-impacts that can cause a complete collapse of the end of the car—resulting in large repair costs—coupled with damage to the lading—resulting in significantly higher insurance premiums.

Increasing the travel of the draft gear assembly may advantageously allow more energy to be absorbed. The challenge of increasing the travel of the draft gear assembly is, however, complicated. Passing sidings and loading facilitates often limit the number of railcars that can be joined to each other in one train. Lengthening the draft gear housing also means lengthening the size or length of the pocket wherein the draft gear assembly is accommodated which requires lengthening the centersill resulting in adding length to the railcar. The length of a railroad car, however, is critical.

By itself, adding to the length of the railcar does not appear problematical. When considering, however, that the railcars are not transported individually but rather as part of a much longer train consist, increasing the length of a single railcar is exponentially multiplied when considering the cumulative or overall length of a 100 railcar train consist. Increasing the length of an individual railcar can result in the last railcar in a 100 car consist no longer fitting on the siding and, thus, having to be left behind. As such, there would be at least a one percent (1%) loss in train efficiency. This is simply unacceptable. Accordingly, the concept of simply increasing the length of the draft gear assembly to solve the problem of energy absorption between railcars is unacceptable to the railroad industry.

Thus, there is a continuing need and desire for a draft gear assembly which not only allows for increased travel over which the high level of energy from impact loads of colliding railcars can be absorbed, dissipated and returned but the overall length of the draft gear assembly housing cannot be lengthened and the draft gear assembly must be capable of absorbing the increased impact loads being realized in today's railroad industry.

SUMMARY

In view of the above, and in accordance with one aspect of this invention disclosure, there is provided a draft gear assembly including a hollow metal housing open at a first end and closed toward the second end thereof. The housing is configured to fit within a standard sized pocket defined by the centersill on the railcar. The housing defines a series of tapered longitudinally extended inner surfaces opening to and extending from the first end of the housing. A series of friction members are equally spaced about a longitudinal axis of the draft gear assembly toward the first end of the housing, with each friction member having axially spaced first and second ends and an outer surface extending between the ends. The outer surface on each friction member is operably associated with one of the tapered longitudinally extended inner surfaces on the housing so as to define a first angled friction sliding surface therebetween.

A wedge member is arranged for axial movements relative to the first end of the housing and to which external forces are applied during operation of the railcar. The wedge member defines a series of outer tapered surfaces equally spaced about the longitudinal axis of the housing and equal in number to the number of friction members. In one form, each outer tapered surface on the wedge member is operably associated with an inner surface on each friction member so as to define a second angled friction sliding surface therebetween and such that the wedge member produces a radially directed force against the friction members upon movement of the wedge member inwardly of the housing. A spring seat is arranged within the housing. One surface of the spring seat is arranged in operable engagement with the second end of each friction member.

A spring assembly is disposed in the housing between the closed end of the housing and a second surface of the spring seat for storing, dissipating and returning energy imparted to the draft gear assembly. The spring assembly includes an axial stack of individual elastomeric springs. In one embodiment, the spring assembly, in operable combination with the disposition of the first and second angled sliding surfaces of the draft gear assembly relative to the longitudinal axis of the draft gear assembly, permits the draft gear assembly to consistently and repeatedly withstand about 70,000 ft-lbs. to about 85,000 ft-lbs. of energy imparted to the draft gear assembly while not exceeding a force level of 600,000 lbs. over a range of travel of the wedge member in an inward axial direction relative to the housing approximating 3.5 inches.

In accordance with this family of embodiments, the first angled friction sliding surface of the draft gear assembly is disposed at an angle ranging between about 1.5 degrees and about 5 degrees relative to the longitudinal axis of the draft gear assembly. Preferably, the second angled friction sliding surface of the draft gear assembly is disposed at an angle ranging between about 32 degrees and about 45 degrees relative to the longitudinal axis of the draft gear assembly. In one form, the elastomeric pad of each individual elastomeric spring is formed from a polyester material having a Shore D hardness ranging between about 40 and 60.

In one embodiment of the invention disclosure, the spring assembly of the draft gear assembly further includes a rigid separator plate disposed between two axially adjacent individual springs in the axial stack of elastomeric springs. The disposition of the separator plate creates different dynamic elastic absorption characteristics on opposite sides thereof whereby optimizing dynamic lost work opportunities during an impact event of the draft gear assembly.

According to another aspect of this invention disclosure there is provided a draft gear assembly including a hollow metal housing open at a first end and closed toward the second end thereof. The draft gear assembly housing is configured to fit within a standard sized pocket defined by the centersill on the railcar. The housing defines a series of tapered longitudinally extended inner surfaces opening to and extending from the first end of the housing. A series of friction members are equally spaced about a longitudinal axis of the housing toward the first end of the housing. Each friction member has axially spaced first and second ends and an outer surface extending between the ends. The outer surface on each friction member is operably associated with one of the tapered longitudinally extended inner surfaces on the housing so as to define a first angled friction sliding surface therebetween.

A wedge member is arranged for axial movements relative to the first end of the housing. External forces are applied to the wedge member during operation of the railcar. Toward an opposite end, the wedge member defines a series of equally spaced outer tapered surfaces. In one form, the outer tapered surfaces on the wedge members are operably associated with inner surfaces on the friction member so as to define a second angled friction sliding surface therebetween and such that the wedge member produces a radially directed force against the friction members upon movement of the wedge member inwardly of the housing. A spring seat is arranged within the housing. One surface of the spring seat is arranged in operable engagement with the second end of each friction member.

A spring assembly is disposed within and between the closed end of the housing and a second surface of the spring seat for storing, dissipating and returning energy imparted thereto. The spring assembly is configured to function in operable combination with the disposition of said first and second angled sliding surfaces of said draft gear assembly such that said draft gear assembly consistently and repeatedly withstands about 110,000 ft-lbs. of energy imparted to the draft gear assembly at a force level not to exceed 900,000 lbs. over a range of travel of the wedge member in an inward axial direction relative to the housing of at least 4.5 inches.

Preferably, the first angled friction sliding surface on the draft gear assembly is disposed at an angle ranging between about 1.5 degrees and about 5 degrees relative to the longitudinal axis of the draft gear assembly. In the preferred form, the second angled friction sliding surface is disposed at an angle ranging between about 32 degrees and about 45 degrees relative to the longitudinal axis of the draft gear assembly.

The spring assembly preferably includes an axial stack of individual elastomeric springs. Each spring includes an elastomeric pad having a generally rectangular shape, in plan, approximating the cross-sectional configuration of the hollow chamber defined by the housing whereby optimizing the capability of the spring assembly to store, dissipate and return energy imparted to the draft gear assembly by the coupler. The elastomeric pad of each individual elastomeric spring is preferably has a Shore D hardness ranging between about 40 and 60. In one embodiment, the spring assembly of the draft gear assembly further includes a rigid separator plate disposed between two axially adjacent individual springs in the axial stack of elastomeric springs to create different dynamic elastic absorption responses on opposite sides of the plate whereby optimizing dynamic lost work opportunities during an impact event of the draft gear assembly.

In another family of embodiments, there is provided a draft gear assembly including a hollow metal housing open at a first end and closed toward the second end thereof. The housing is configured to fit within a standard sized pocket defined by a centersill on a railcar. The housing defines a series of tapered longitudinally extended inner surfaces opening to and extending from the first end of the housing. A series of friction members are equally spaced about a longitudinal axis of the housing and are arranged toward the first end of the housing. Each friction member has axially spaced first and second ends and an outer surface extending between the ends. The outer surface on each friction member is operably associated with one of the tapered longitudinally extended inner surfaces on the housing so as to define a first angled friction sliding surface therebetween.

A wedge member is arranged for axial movements relative to the first end of the housing. External forces are applied to the wedge member during operation of the railcar. The wedge member defines a series of equally spaced outer tapered surfaces. In one form, each outer tapered surface on the wedge member operably associates with an inner surface on each friction member so as to define a second angled friction sliding surface therebetween. In operation, the wedge member produces a radially directed force against the friction members upon movement of the wedge member inwardly of the housing. A spring seat is arranged within the housing. One surface of the spring seat is arranged in operable engagement with the second end of each friction member.

A spring assembly is arranged between the closed end of the housing and a second surface of the spring seat for storing, dissipating and returning energy imparted to the draft gear assembly. The spring assembly of each draft gear assembly is configured and operates in operable combination with the first and second angled surfaces on the draft gear assembly such the draft gear assembly consistently and repeatedly withstands about 70,000 ft-lbs to about 110,000 ft-lbs. of energy imparted thereto while not exceeding a force level of 900,000 lbs. over a range of travel of wedge member in an inward axial direction relative to the housing of about 4.5 inches.

Preferably, the first angled friction sliding surface on the draft gear assembly is disposed at an angle ranging between about 1.5 degrees and about 5 degrees relative to the longitudinal axis of the draft gear assembly. In one form, the second angled friction sliding surface is disposed at an angle ranging between about 32 degrees and about 45 degrees relative to the longitudinal axis of the draft gear assembly.

In one embodiment, the housing of each draft assembly has two pairs of joined and generally parallel walls extending from the closed end toward the open end of the housing such that the walls define a hollow chamber having a generally rectangular cross-sectional configuration, in plan, for a major portion of the length thereof and which opens to the open end of the housing. Preferably, the spring assembly includes an axial stack of individual elastomeric springs, with each spring including an elastomeric pad having a generally rectangular shape, in plan, approximating the cross-sectional configuration of the hollow chamber defined by the housing whereby optimizing the capability of the spring assembly to store, dissipate and return energy imparted to the draft gear assembly. In a preferred embodiment, the elastomeric pad of each individual elastomeric spring has a Shore D hardness ranging between about 40 and 60.

In one embodiment, the spring assembly of the draft gear assembly further includes a rigid separator plate disposed between two axially adjacent individual springs in the axial stack of elastomeric springs so as to create different dynamic elastic absorption reaction on opposite sides of the separator plate whereby optimizing dynamic lost work opportunities during an impact event of the draft gear assembly. In one form, a first group of springs, disposed to one side of the separator plate, have a different cumulative spring rate than a group of springs disposed to an opposite side of the separator plate. In this later embodiment, the group of springs disposed between the separator plate and the spring seat offer less resistance to axial compression than the group of springs disposed between the opposite side of the separator plate and the closed end of the housing.

DETAILED DESCRIPTION

Figure 1:
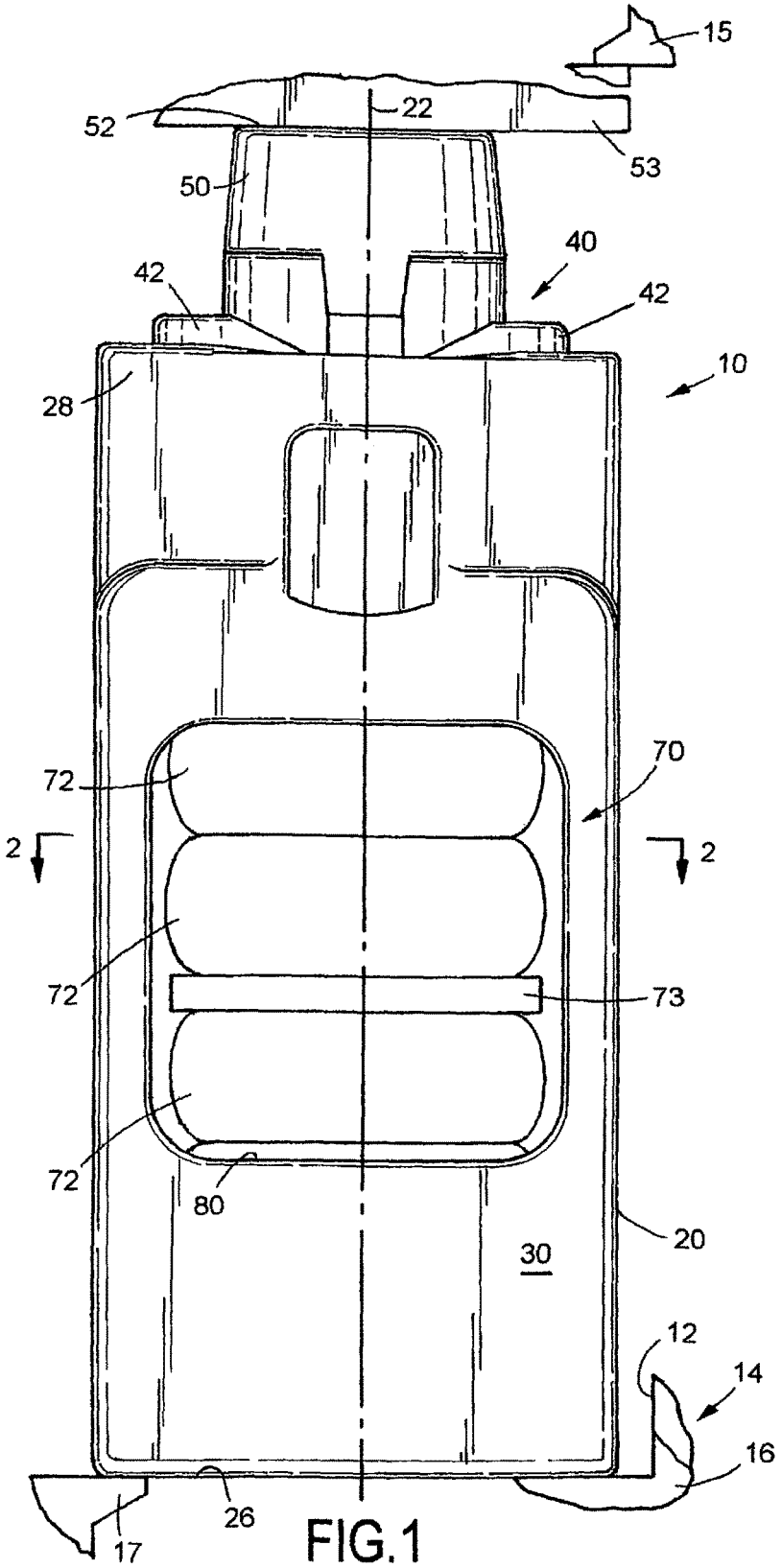
FIG. 1 is a side elevational view of a draft gear assembly of this invention disclosure.

While this invention disclosure is susceptible of embodiment in multiple forms, there is shown in the drawings and will hereinafter be described preferred embodiments, with the understanding the present disclosure is to be considered as setting forth exemplifications of the disclosure which are not intended to limit the disclosure to the specific embodiments illustrated and described.

Referring now to the drawings, wherein like reference numerals indicate like parts throughout the several views, there is shown in FIG. 1 a railroad car draft gear assembly, generally identified by reference numeral 10, and embodying teachings and principals of this invention disclosure. One of the many advantages of the draft gear assembly 10 of this invention disclosure being that it can be relatively easily installed without incurring any changes or modifications to a standard sized pocket 12 defined by a centersill 14 on a railcar 16.

The centersill 14 can be cast or fabricated and has many standard features. As shown in FIG. 1, the centersill 14 has longitudinally or axially spaced front and rear stops 15 and 17, respectively, connected to and carried by sidewalls (not shown) on the centersill 14. The longitudinal distance between the inboard face of the front stop 15 and the inboard face of the rear stop is 24.625 inches.

As shown in FIG. 1, draft gear assembly 10 includes an axially elongated hollow and metallic housing 20 defining a longitudinal axis 22. Housing 20 is closed by an end wall 24 (FIG. 4) at a first or closed end 26 and is open toward an axially aligned second or open end 28.

Figure 2:
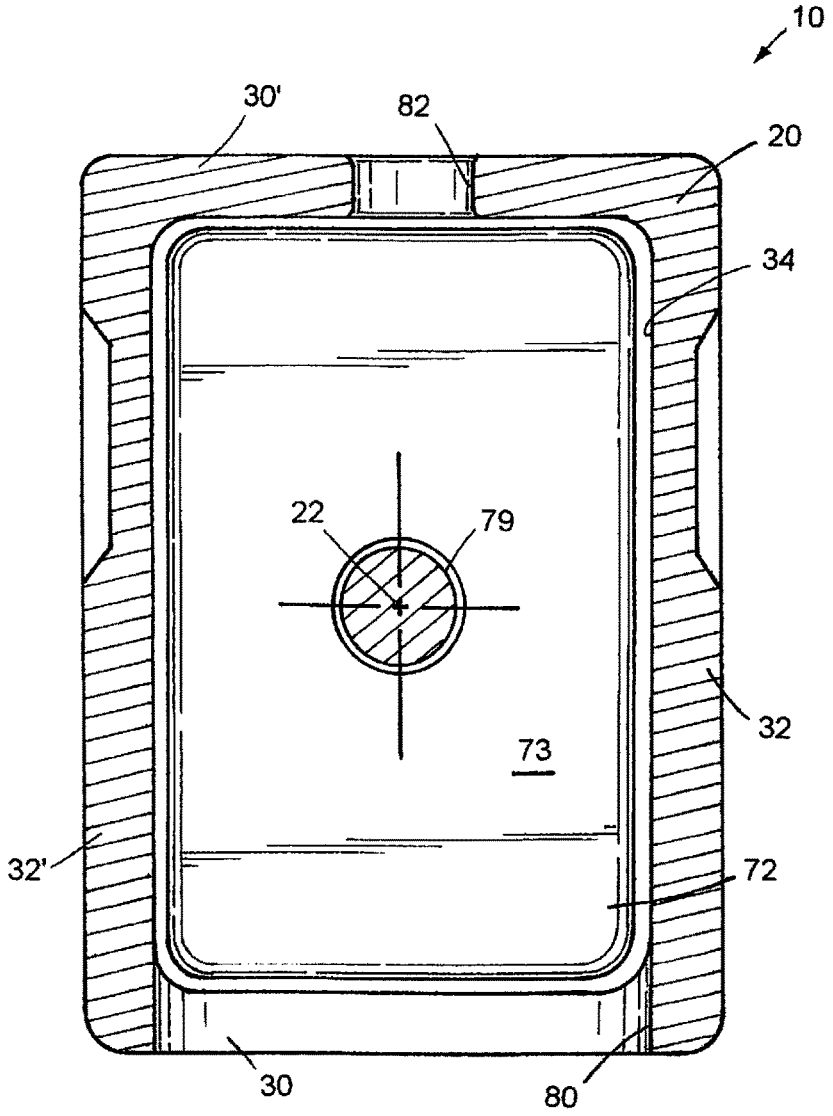
FIG. 2 is a sectional view taken along line 2-2 of FIG. 1.
Figure 3:
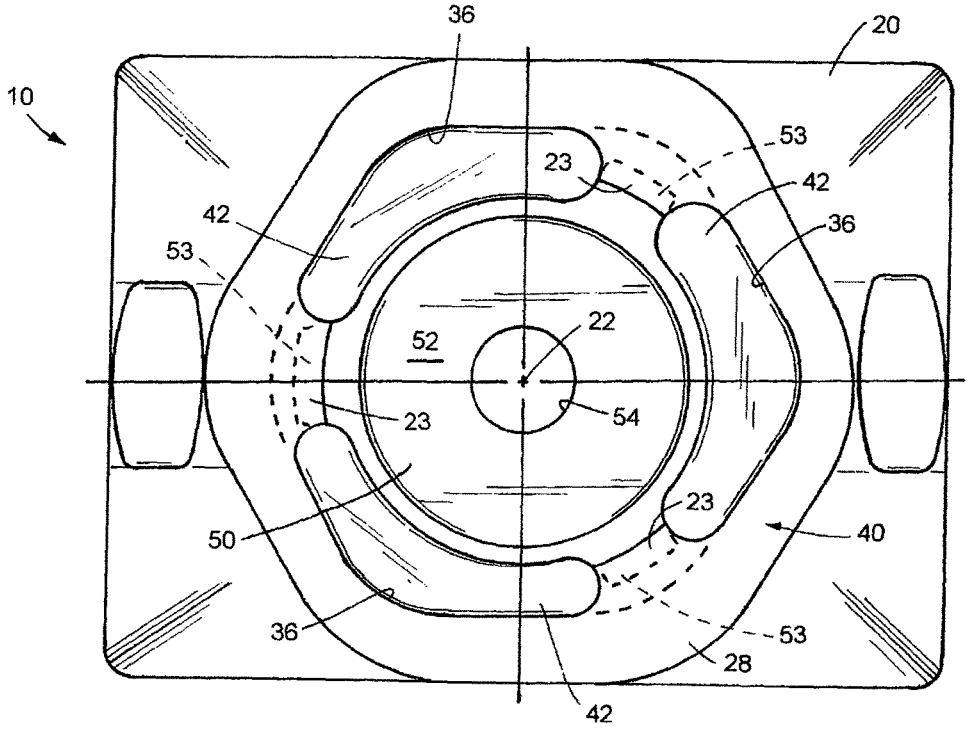
FIG. 3 is a longitudinal sectional view of the draft gear assembly illustrated in FIG. 1.

In the embodiment illustrated in FIG. 2, housing 20 includes two pairs of joined and generally parallel walls 30, 30' and 32, 32', extending from the closed end 26 toward the open end 28 and defining a hollow chamber 34 within housing 20 (FIGS. 2 and 3). As shown in FIG. 2, the housing walls 30, 30' and 32, 32' provide the housing chamber 34 with a generally rectangular or box-like cross-sectional configuration, in plan, for a major lengthwise portion thereof.

Moreover, and as shown in FIG. 3, toward the open end 28, housing 20 is provided with a plurality (with only one being shown in FIG. 5) of equi-angularly spaced and longitudinally extended tapered inner angled friction surfaces 36. Each tapered inner angled friction surfaces 36 on housing 20 converges toward the longitudinal axis 22 and toward the closed end 26 of the draft gear housing 20. Preferably, housing 20 is provided with three equally spaced longitudinally extended and tapered inner angled friction surfaces 36 but more tapered surfaces could be provided without detracting or departing from the spirit and novel concept of this invention disclosure.

In the embodiment shown in FIG. 3, draft gear assembly 10 is also provided with a friction clutch assembly 40 for dissipating forces or impacts axially directed against the draft gear assembly 10 as a result of a coupling operation or normal operation of the railcar 16 (FIG. 1). In the embodiment shown in FIGS. 3 and 4, the friction clutch assembly 40 includes a plurality of friction members or shoes 42 radially arranged about axis 22 and in operable combination with the open end 28 of the draft gear housing 20. As shown by way of example in FIG. 3, the friction clutch assembly 40 can be provided with three equi-angularly spaced friction members 42 but more friction members could be provided without detracting or departing from the spirit and novel concept of this invention disclosure. Suffice it to say, in the embodiment shown by way of example in FIGS. 3 and 4, the number of friction members 42 forming part of the friction clutch assembly 40 are equal in number to the number of tapered inner angled friction surfaces 36 on housing 20.

Figure 5:
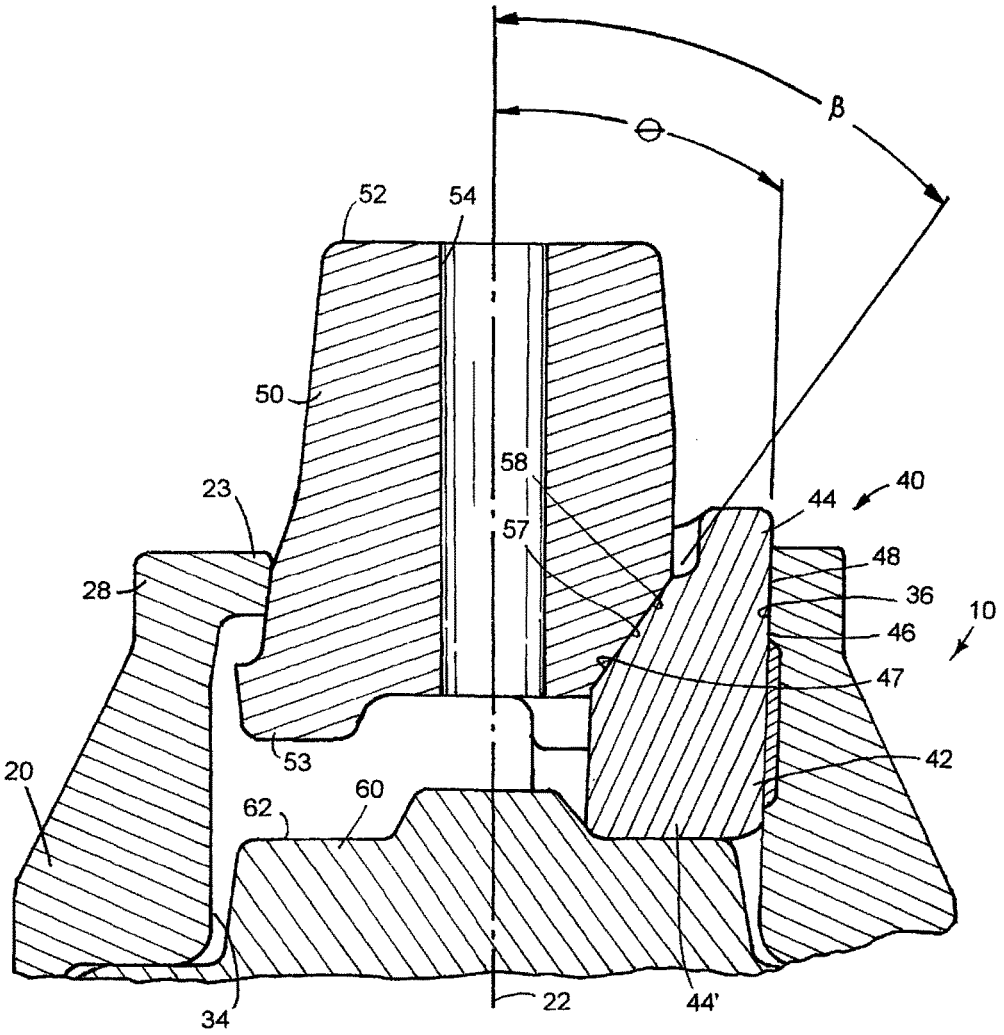
FIG. 5 is an enlarged sectional view of one end of the draft gear assembly illustrated in FIG. 1.

In the embodiment shown by way of example in FIG. 5, each friction member 42 has axially or longitudinally spaced first and second end 44 and 44', respectively. Moreover, each friction member 42 has an outer or external tapered sliding surface 46. As will be appreciated by those skilled in the art, each inner angled friction surface 36 on housing 20 combines with each outer tapered sliding surface 46 on each friction member 42 to define a first angled friction sliding surface 48 therebetween. The first friction sliding surface 48 is disposed at an angle θ relative to the longitudinal axis 22 of the draft gear assembly 10. Preferably, the angle θ of the first friction sliding surface 48 ranges between about 1.5 degrees and about 5 degrees relative to the longitudinal axis 22 of the draft gear assembly 10. In a preferred embodiment, the angle θ of the first friction sliding surface 48 ranges between about 1.7 degrees and about 2 degrees relative to the longitudinal axis 22 of the draft gear assembly 10.

Figure 4:
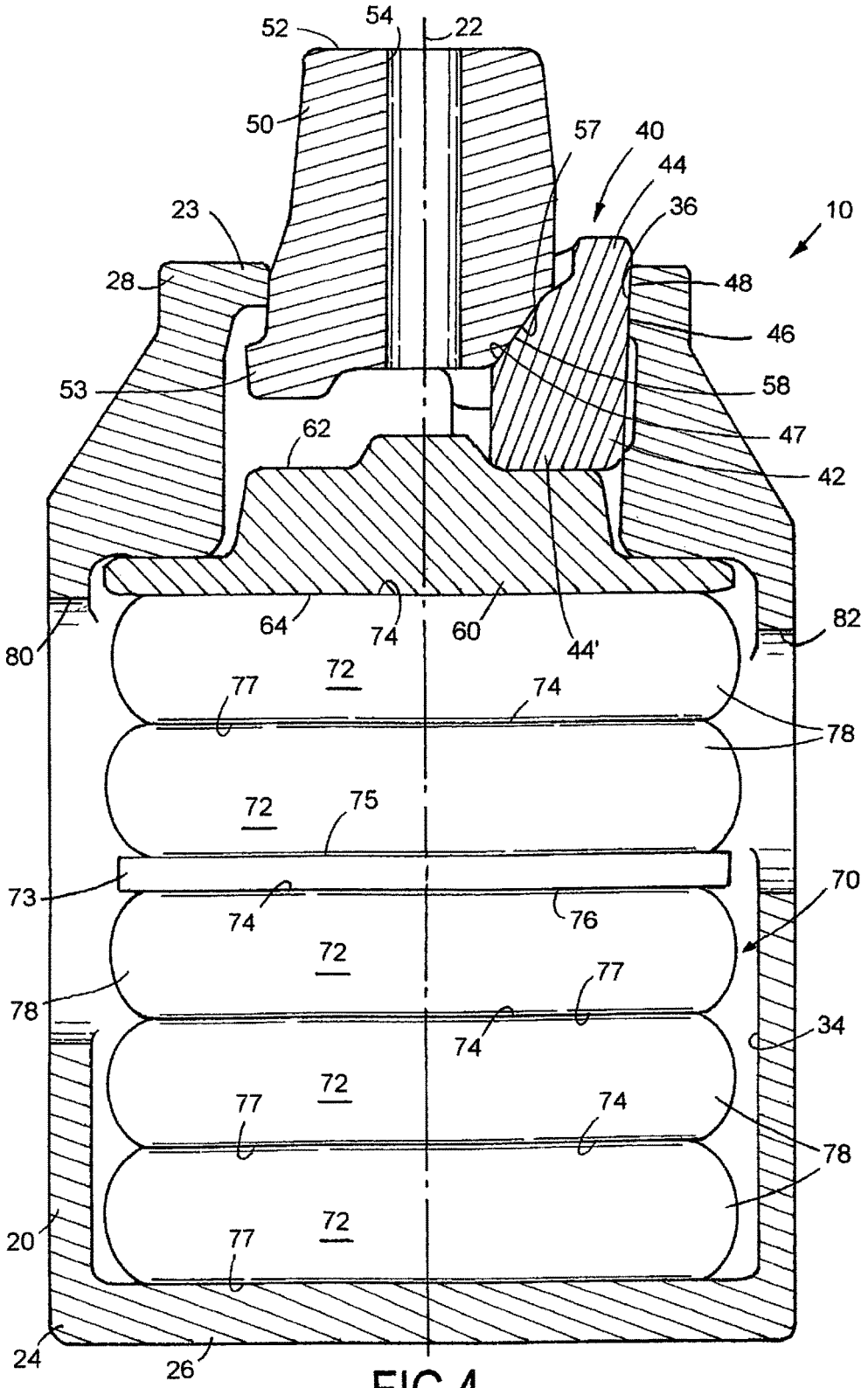
FIG. 4 is an axial plan view of the draft gear assembly illustrated in FIG. 1.

In the illustrated embodiment, the friction clutch assembly 40 further includes a wedge member or actuator 50 arranged for axial movement relative to the open end 28 of housing 20. As shown in FIGS. 1, 4 and 5, an outer end 52 of the wedge member 50 preferably has a generally flat face extending beyond the open end 28 of housing 20 for a distance measuring about 4.5 inches and is adapted to press or bear against a conventional follower 53 such that impact forces directed against to an against the actuator 50 are axially applied to the draft gear assembly 10 during operation of the railcar 16 (FIG. 1). As known, wedge member 50 is arranged in operable combination with the friction members 42.

In the embodiment illustrated by way of example in FIG. 5, wedge member or actuator 50 defines a plurality of outer tapered or angled friction surfaces 57 arranged in operable combination with the friction members 42 of the clutch assembly 40. Although only one friction surface 57 illustrated in FIG. 5, the number of friction surfaces 57 on the wedge member 50 equals the number of friction surfaces on members 42 forming part of the clutch assembly 40.

In the embodiment illustrated by way of example in FIG. 5, each outer angled friction surface 57 on wedge member 50 combines with an inner angled sliding surface 47 on each friction member 42 to define a second angled friction sliding surface 58 therebetween. The second friction sliding surface 58 is disposed at an angle β relative to the longitudinal axis 22 of the draft gear assembly 10. Preferably, the angle β of the second friction sliding surface 58 of friction clutch assembly 40 ranges between about 32 degrees and about 45 degrees relative to the longitudinal axis 22 of the draft gear assembly 10.

Wedge member 50 is formed from any suitable metallic material. In a preferred form, and as shown in FIGS. 3, 4 and 5, the wedge member or actuator 50 defines a generally centralized longitudinally extending bore 54.

As shown in FIGS. 3, 4 and 5, toward the open end 28, housing 20 is provided with a series of radially inturned stop lugs 23 which are equi-angularly spaced circumferentially relative to each other. Toward a read end thereof, wedge member 50 includes a series of radially outwardly projecting lugs 53 which are equi-angularly disposed relative to each other and extend between adjacent friction members 42 so as to operably engage in back of the lugs 23 on housing 20 and facilitate assembly of the draft gear assembly 10.

As shown in FIG. 5, draft gear assmbly 10 furthermore includes a spring seat or follower 60 arranged within the hollow chamber 34 of housing 20 and disposed generally normal or generally perpendicular to the longitudinal axis 22 of the draft gear assembly 10. Spring seat 60 is adapted for reciprocatory longitudinal or axial movements within the chamber 34 of housing 20 and has a first surface 62 in operable association with the second or rear end 44' of each friction member 42. As shown in FIG. 4, spring seat 60 also has a second or spring contacting surface 64.

An axially elongated elastomeric spring assembly 70 is generally centered and slidable within chamber 34 of the draft gear housing 20 and forms a resilient column for storing, dissipating and returning energy imparted or applied to the free end 52 of wedge member 50 during axial compression of the draft gear assembly 10. One end of spring assembly 70 is arranged in contacting relation with the end wall 24 of housing 20. A second end of spring assembly 70 is pressed or urged against surface 64 of the spring seat 60 to oppose inward movements of the friction members 42 and wedge member 50 in response to impact forces being directed to and/or against the draft gear assembly 10.

Spring assembly 70 is precompressed during assembly of the draft gear assembly 10 and serves to: 1) maintain the components of the friction clutch assembly 40, including friction members 42 and wedge member 50 in operable combination relative to each other and within the draft gear housing 20 both during operation of the draft gear assembly 10 as well as during periods of non-operation of the draft gear assembly 10; 2) maintain the free end 52 of wedge member 50 pressed against the follower 53 (FIG. 1); and, 3) maintain the follower 53 and the draft gear housing 20 pressed against stops 15 and 17 on the centersill 14 (FIG. 1), respectively. In the illustrated embodiment, spring assembly 70, in combination with the friction clutch assembly 40, is capable of absorbing and dissipating impacts or energy directed axially thereto up to about 900,000 lbs.

In the form shown in FIG. 4, spring assembly 70 is configured with a plurality of individual units or springs 72 arranged in axially stacked adjacent relationship relative to each other. In the form shown in FIG. 4, the spring assembly 70 is comprised of five springs 72 with a rigid separator plate 73 being disposed between two axially adjacent springs 72 in the stack of the springs. It will be appreciated that more than five springs 72 can be arranged in axially stacked relationship relative to each other without seriously detracting or departing from the novel nature and true scope of this invention disclosure.

As described in further detail below, the purpose of the separator plate 73 between the springs 72 is to provide the springs 72 with different dynamic elastic absorption characteristics on opposite sides of the separator plate 73 so as to optimize dynamic lost work opportunities during an impact event of the draft gear assembly 10. To effect such desirous ends, the separator plate 73 is extremely rigid and is preferably formed from steel or the like.

As shown in FIG. 4, plate 73 has upper and lower generally planar and generally parallel spring engaging surfaces 74 and 76, respectively. In one form, a distance of about 0.375 inches to about 0.5 inches separates the spring engaging surfaces 74 and 76 on plate 73. The separator plate 73 preferably has a generally rectangular configuration which allows it to freely move within the chamber 34 in the same direction as do the springs 72 in response to an axial load being placed on the spring assembly 70.

In a preferred embodiment, the springs 72 disposed between the lower surface 76 of plate 73 and the end wall 24 of housing 20 combine with each other to offer a greater resistance to compression than do the combination of springs 72 disposed between the upper spring engaging surface 74 of plate 73 and the spring engaging surface 64 of spring seat 60.

Each cushioning unit or spring 72 includes an elastomeric pad 78. Preferably, each spring 72 has a configuration which complements the configuration, in plan, of the housing chamber 34. In a preferred form, each spring 72 has a generally rectangular shape, in plan, and is sized to optimize the rectangular area of the hollow chamber 34 wherein spring assembly 70 is slidably centered for axial endwise movements in response to loads or impacts being exerted axially against the draft gear assembly 10. Preferably, the pad 78 of each elastomeric spring 72 has two spaced and generally planar surfaces 74 and 77. As shown in FIG. 4, the planar surface 74 of the pad 78 of the uppermost spring 72 in the stack of springs 72 is pressed against the spring contacting surface 64 of spring seat 70. As further shown in FIG. 4, and with the exception of the pads 78 arranged adjacent to plate 73, the lower planar surface 77 on the pad 78 of any two axially adjacent springs 72 abuts with and is pressed against the planar surface 74 of an axially adjacent spring 72. Moreover, the planar surface 77 of the pad 78 on the lowermost spring in the stack of springs 72 is pressed against the end wall 24 of housing 20.

Preferably, the elastomeric pad 78 and thereby each spring 72, comprising spring assembly 70 is configured such that its radial expansion, in response to impacts or loads being placed thereon, is limited by the walls of housing 20 thereby enhancing the absorption capabilities of spring assembly 70. Turning again to FIG. 2, each spring pad 78 is preferably configured such that the radial or outward expansion of the pad 78 will be limited by the housing walls 32, 32' before the pad 78 expands to engage housing walls 30, 30'. In a preferred embodiment, and during operation of the draft gear assembly 10, and especially those pads 78 of springs 72 disposed closer to the spring seat 60, will radially expand in response to an impact load being placed thereon, to such an extend as they positively engage and/or contact against the inner surface of the housing walls 32 and 32' whereby enhancing the absorption capabilities of those springs 72 of the spring assembly 70 disposed closest to the spring seat 60. In one form of this invention disclosure, the springs 72 are maintained in general axial alignment with each other and relative to the longitudinal axis 22 during operation of the draft gear assembly 10 by an elongated guide rod 79 (FIG. 2) which, in one form, preferably extends substantially the entire length of the spring assembly 70.

Preferably, each elastomeric pad 78 is formed from a polyester material having a Shore D durometer hardness ranging between about 40 and 60 and an elastic strain to plastic strain ratio of about 1.5 to 1. The working process and methodology for creating the each spring unit 72 involves creating a preform block which is precompressed to greater than 30% of the preformed height of the preform thereby transmuting the preform into an elastomeric spring.

In one embodiment of the present invention disclosure, the durometer hardness of those elastomeric springs comprising spring assembly 70 may be different relative to each other. That is, the cumulative durometer hardness of the springs 72 disposed between spring seat 60 and plate 73 can be different from the cumulative durometer hardness of the springs 72 disposed between housing end wall 24 and plate 73. As mentioned, however, it is preferable for the cumulative durometer hardness of the springs 72 between the housing end wall 24 and plate 73 to be greater or harder than the cumulative durometer hardness of the springs 72 between spring seat 60 and plate 73. Such a design allows the functionality and performance characteristics of the of the draft gear assembly 10 to be "fine tuned" to the particular environment wherein the draft gear assembly 10 is to be used and function.

As shown in FIGS. 1, 2 and 4, a relatively large rectangular opening 80 is preferably formed in wall 30 of the draft gear housing 20. Opening 80 is sized such that one or more of the spring units 72 and plate 73 can be inserted through the opening 80 in a direction extending generally normal to the longitudinal axis 22 of the draft gear assembly 10 and into the hollow chamber 34 of housing 20. Housing wall 30' may also be provided with an opening 82. Preferably, the peripheral margin 84 of opening 82 defines a smaller area than the margin 83 of opening 80.

Figure 6:
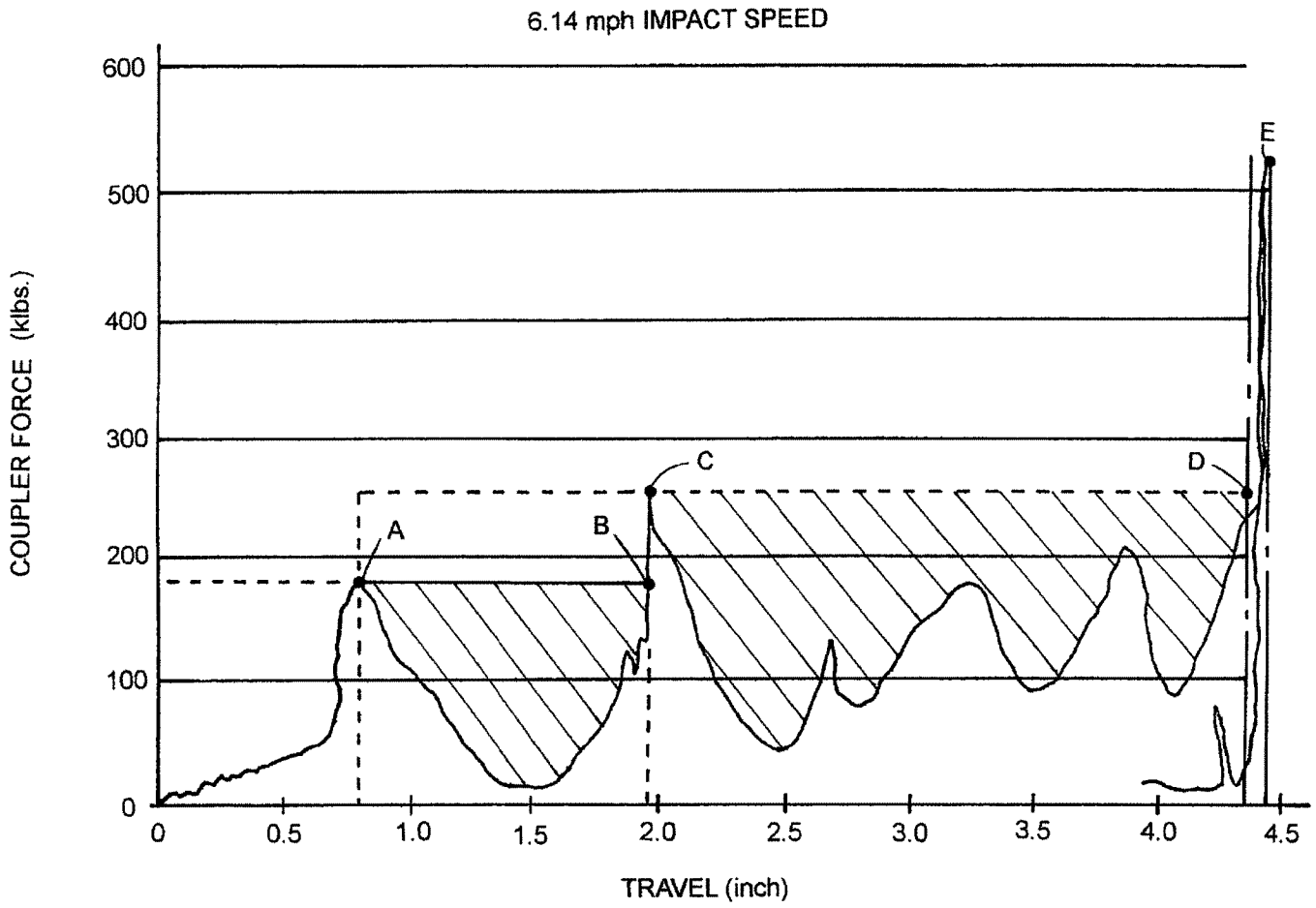
FIG. 6 is a is a schematic graphical representation of the forces realized by a conventional draft gear assembly.
Figure 7:
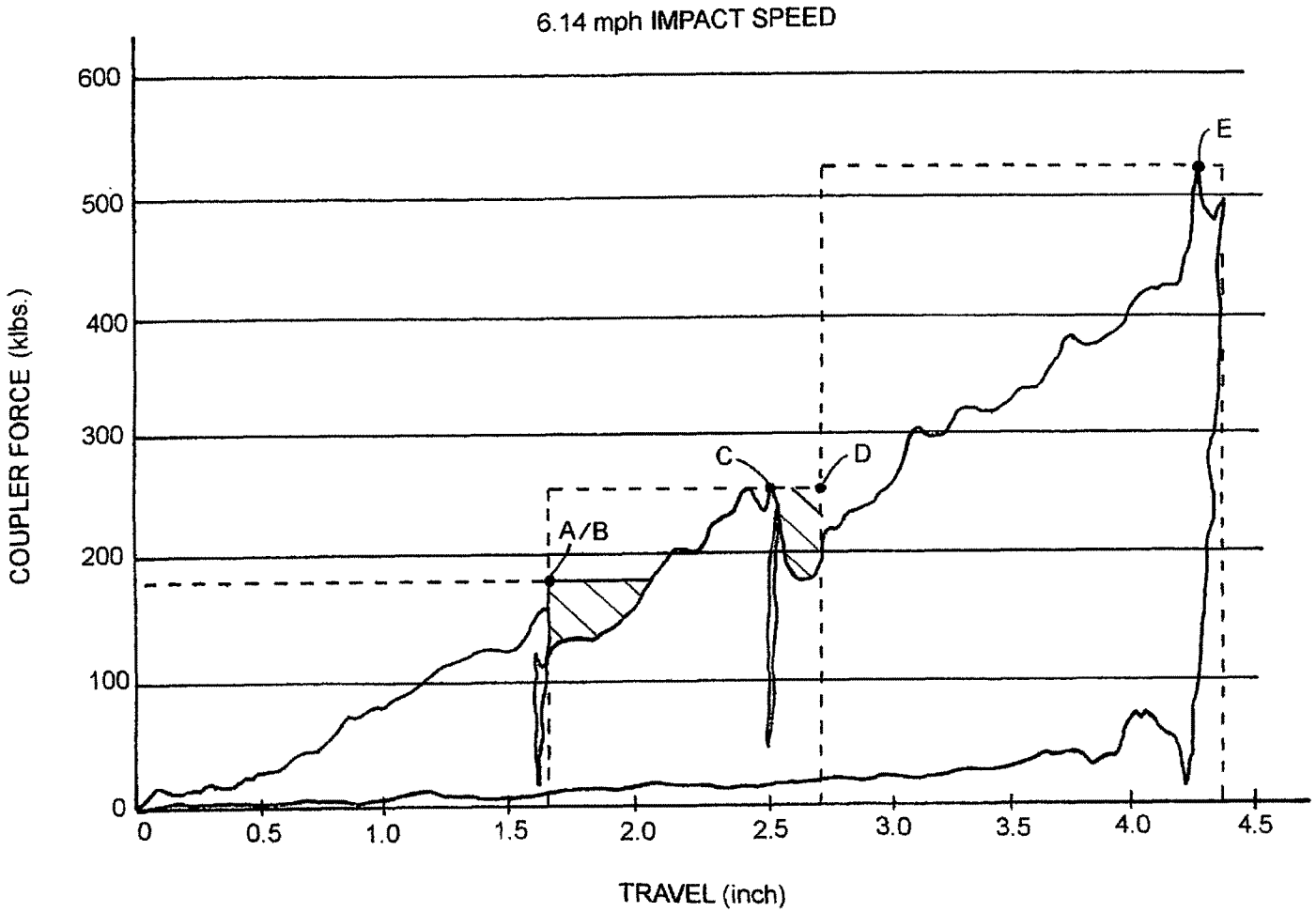
FIG. 7 is a schematic graphical representation of the forces realized by a draft gear assembly having a spring assembly embodying some of the principals and teachings of this invention disclosure.

As mentioned above, the purpose of the rigid separator plate 73 between the springs 72 is to provide the springs 72 with different dynamic elastic absorption characteristics on opposite sides of the separator plate 73 so as to optimize dynamic lost work opportunities during an impact event of the draft gear assembly 10. FIG. 6 is a schematic graphical representation of the forces realized by a conventional friction/elastomeric draft gear assembly. Whereas, FIG. 7 is a schematic graphical representation of the forces realized by a draft gear assembly embodying a spring assembly 70 as described above and configured with a separator plate 73 between the opposed ends thereof. A comparison between FIGS. 6 and 7 quickly and readily reveals how the spring assembly 70 configured with plate 73 disposed between opposed ends of the spring assembly 70 optimizes the dynamic lost work opportunities during an impact event of the draft gear assembly 10.

As used herein and throughout, the phrase "lost work opportunity" means and refers to where the force levels imparted to the draft gear assembly drop-off or fall off dramatically over a given travel. The areas shown in dash lines in FIG. 6 between points A-B and C-D represent lost work opportunities for a conventional draft gear assembly. FIG. 7 schematically represents force levels for a given travel of a draft gear assembly embodying principals and teachings of the present invention disclosure. The points A, B, C, D and E in FIG. 7 are similar to the force levels for a given travel schematically represented at points A, B, C, D and E in FIG. 6. The force levels for a given travel shown in FIG. 6 as compared to the force levels for a given travel shown in FIG. 7 shows how the a draft gear assembly embodying those features and teachings of the present invention disclosure optimizes the lost work opportunities during an impact event on the draft gear assembly 10. In the embodiment shown by way of example in FIG. 7, the distance between points D and E schematically represent additional work opportunities provided by a draft gear assembly embodying the teachings and principals of this invention disclosure.

Figure 8:
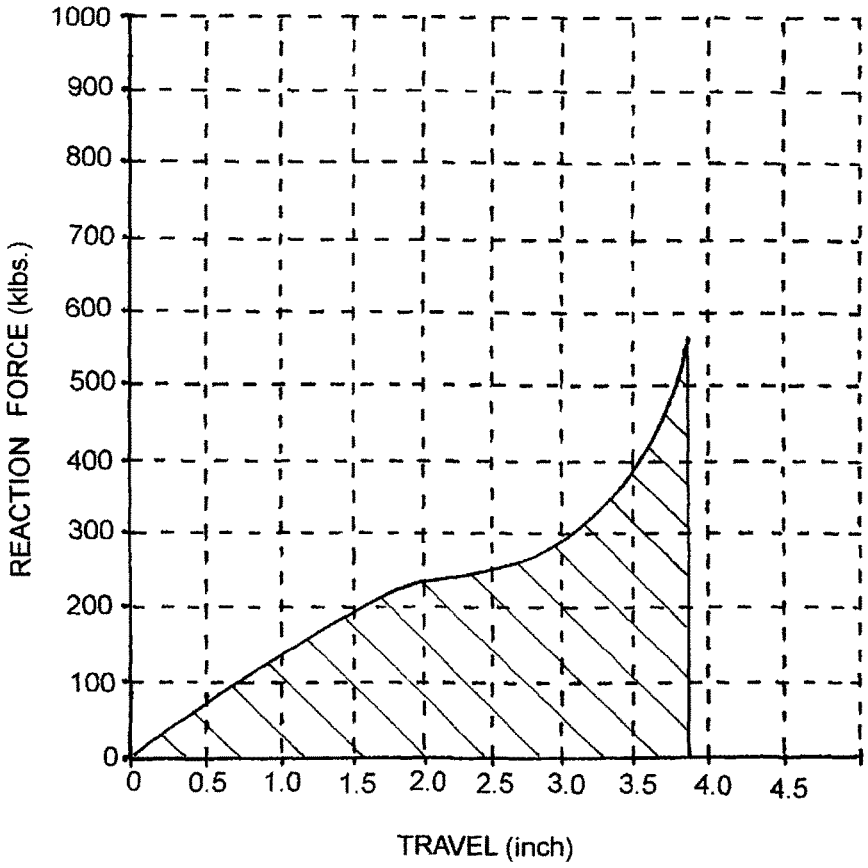
FIG. 8 is a schematic representation of the performance of one form of draft gear assembly embodying principals and teachings of this invention disclosure.

FIG. 8 schematically represents the performance of a draft gear assembly 10 embodying the principals and teachings of this invention disclosure, with the spring assembly 70 being configured to function in combination with the angles θ and β of the first and second friction sliding surfaces 48 and 58, respectively, relative to the longitudinal axis 22 the draft gear assembly 10. As shown in FIG. 8, such a draft gear 10 consistently and repeatedly withstands between about 70,000 ft-lbs. and about 85,000 ft-lbs. of energy imparted thereto at a force level not exceeding 600,000 lbs. over a range of travel of the wedge member 50 in an inward axial or longitudinal direction relative to the draft gear housing 20 approximating 3.9 inches.

Figure 9:
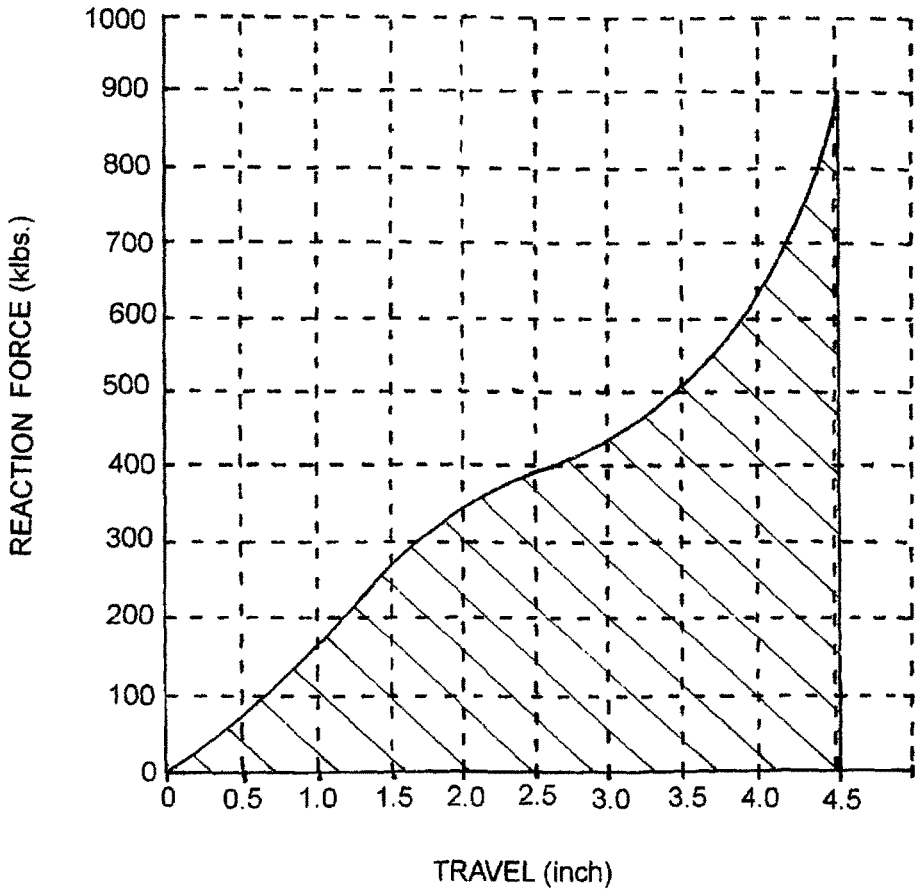
FIG. 9 is a schematic representation of the performance of another form of draft gear assembly embodying principals and teachings of this invention disclosure.

Alternatively, FIG. 9 schematically shows performance of a draft gear 10 with the spring assembly 70 of the draft gear assembly 10 being configured to function in operable combination with the angles θ and β of the first and second friction sliding surfaces 48 and 58, respectively, relative to the longitudinal axis 22. As shown, the draft gear assembly 10 consistently and repeatedly withstands about 110,000 ft-lbs. of energy of energy imparted thereto at a force level not exceeding 900,000 lbs. over a range of travel of the wedge member 50 in an inward axial direction relative to the draft gear housing 20 not exceeding 4.5 inches Suffice it to say, FIG. 9 also schematically shows performance of a draft gear 10 with the spring assembly 70 being configured to function in operable combination with the angles θ and β of the first and second friction sliding surfaces 48 and 58, respectively, relative to the longitudinal axis 22 the draft gear assembly 10. As shown, the draft gear assembly 10 consistently and repeatedly withstands between about 70,000 ft-lbs energy to about 110,000 ft-lbs of energy imparted thereto while not exceeding a force level of about 900,000 lbs. over a range of travel of the wedge member 50 in an inward axial direction relative to the draft gear housing 20 not exceeding 4.5 inches.

With the present invention disclosure, and with no design changes to the centersill 14 on railcar 16, the draft gear assembly 10 is configured such that the wedge member 50 can achieve a range of longitudinal or horizontal movement in one axial direction of about 4.5 inches. That is, the draft gear assembly 10 of this invention disclosure permits 4.5 inches of travel in a "buff" direction and 4.5 inches of travel in a "draft" direction. This advantageous gain in longitudinal movement of the wedge member 50 allows the draft gear assembly 10 to consistently and repeatedly withstand between about 70,000 ft-lbs and about 110,000 ft-lbs of energy imparted thereto while not exceeding a force level of about 900,000 lbs. over a range of travel of the wedge member 50 in an inward axial direction relative to the draft gear housing 20 not exceeding 4.5 inches.

From the foregoing, it will be observed that numerous modifications and variations can be made and effected without departing or detracting from the true spirit and novel concept of this invention disclosure. Moreover, it will be appreciated, the present disclosure is intended to set forth exemplifications which are not intended to limit the disclosure to the specific embodiments illustrated. Rather, this disclosure is intended to cover by the appended claims all such modifications and variations as fall within the spirit and scope of the claims.

What is claimed is:

1. A railcar draft gear assembly for a railcar having a centersill defining a pocket having a distance of 24.625 inches between stops thereon, comprising:

a hollow metal housing open at a first end and closed toward the second end thereof and configured to fit within the pocket defined by the centersill on the railcar, with the housing defining a series of tapered longitudinally extended inner surfaces opening to and extending from the first end of the housing;

a series of friction members equally spaced about a longitudinal axis of the housing toward the first end of the housing, with each friction member having axially spaced first and second ends and an outer surface extending between the ends, with the outer surface on each friction member being operably associated with one of the tapered longitudinally extended inner surfaces on the housing so as to define a first angled friction sliding surface therebetween;

a wedge member arranged from axial movement relative to the first end of the housing, with said wedge member having a free end extending beyond the open end of said housing and to which an external force is applied during operation of the railcar, with the wedge member defining a series of outer tapered surfaces equally spaced about the longitudinal axis of the housing, with the outer tapered surface on the wedge member being operably associated with an inner surface on each friction member so as to define a second angled friction sliding surface therebetween and such that the wedge member produces a radially directed force against the friction members upon movement of the wedge member inwardly of the housing;

a spring seat arranged within the housing, with one surface of the spring seat being arranged in operable engagement with the second end of each friction member;

a spring assembly disposed in the housing between the closed end of the housing and a second surface of the spring seat for storing, dissipating and returning energy imparted to the draft gear assembly, with said spring including an axial stack of individual elastomeric springs, with each elastomeric spring including an elastomeric pad having a generally rectangular shape, in plan, approximating the cross-sectional configuration of the hollow chamber defined by the housing, and with the elastomeric pads disposed adjacent to the spring seat extending into positive engagement with an inner surface of the housing in dynamic response to an axial load being imparted to said railcar draft gear assembly, and with the elastomeric pad of each individual elastomeric spring having a Shore D hardness ranging between about 40 and 60; and wherein the spring assembly is furthermore configured to function in operable combination with the disposition of said first and second angled sliding surfaces of said draft gear assembly such that said draft gear assembly consistently and repeatedly withstands greater than 96,000 ft-lbs and up to 110,000 ft-lbs. of energy imparted to the draft gear assembly at a force level not to exceed 900,000 lbs. over a range of travel of the wedge member in an inward axial direction relative to the housing up to 4.5 inches.

2. The railcar draft gear assembly according to claim 1, wherein the first angled friction sliding surface of said draft gear assembly is disposed at an angle ranging between about 1.5 degrees and about 5 degrees relative to the longitudinal axis of the draft gear assembly.

3. The railcar draft gear assembly according to claim 1, wherein the second angled friction sliding surface of said draft gear assembly is disposed at an angle ranging between about 32 degrees and about 45 degrees relative to the longitudinal axis of the draft gear assembly.

* * * * *